United States Patent [19]

Chronis et al.

[11] Patent Number: 4,633,553

[45] Date of Patent: Jan. 6, 1987

[54] ADJUSTABLE, LOCKING SEAMING ROLLER PIN

[76] Inventors: Constantine P. Chronis; Patrick F. Chronis, both of P.O. Box 4840, Santa Clara, Calif. 95054

[21] Appl. No.: 756,874

[22] Filed: Jul. 18, 1985

[51] Int. Cl.[4] ..... B21B 13/02; B23P 17/00

[52] U.S. Cl. ..... 29/116 R; 29/148.4 D; 29/527.1; 29/557

[58] Field of Search ..... 29/116 R, 110, 148.4 D, 29/527.1, 557; 305/14

[56] References Cited

U.S. PATENT DOCUMENTS 2,915,326 12/1959 Mason ..... 305/14

*Primary Examiner*—Howard N. Goldberg
*Assistant Examiner*—Irene Graves Golabi
*Attorney, Agent, or Firm*—Townsend & Townsend

[57] ABSTRACT

An improved seaming roller for use in automated canning machines to form seams between can lids and can bodies is disclosed. The seaming roller comprises a spindle mountable to the canning machine, a roller body rotatable about the spindle and having die surfaces for pressing against can lids to form seals, a pair of roller bearings to facilitate rotation, and a grease path for lubricating the bearings through the spindle. The seaming roller includes a positioner screw for properly positioning the roller body and bearings on the spindle such that the roller body can rotate freely without wobble and thus maintain the die surfaces in proper engagement to the can lids. A throughgoing bore is defined along the length of the spindle. The positioner screw is locked in position with a locking pin, inserted in the throughgoing bore and a locking screw which forces the locking pin against the positioner screw.

11 Claims, 6 Drawing Figures

ADJUSTABLE, LOCKING SEAMING ROLLER PIN

BACKGROUND OF THE INVENTION

This invention relates to improvements in seaming rollers for automated canning machinery; more specifically, this invention relates to an adjustable, locking pin for seaming rollers.

Seaming rollers are used in automated machinery for packaging foods and the like in metal cans. In assembling a can, typically the top and bottom can lids are affixed to a generally cylindrical can body. The sheet metal along the rim of the can body is forced outward and somewhat downward to form a lip. A generally circular disc of similar material, which will form the can lid, is bent downward about its outer periphery to form a circular flange. The can lid is placed over the can body and the flange of the can lid is forced inward and upward to extend between the can body and the lip. The can body lip and the can lid flange are then pressed together, sometimes with a gasket material interleaved between the flange and the lip, to form an asceptic seal or seam which is both air-tight and leak-proof.

The operations for sealing can lids to can bodies are performed by pressing the lid and body against rotating dies generally referred to as seaming rollers. Each seaming roller typically has one or two types of die surfaces, one for forcing the flange into position between the can body and the lip, and a second die surface for pressing the can lid and can body together to form the seal.

Typically, seaming rollers include a spindle which can be mounted to the canning machine and a generally ring-shaped body rotatable on bearings about the spindle. The appropriate die surfaces for sealing can lids to can bodies are defined along the periphery of the rollers. A typical automated canning machine seals several cans at once by utilizing twelve or more seaming rollers, adapted to the particular size and type of can being used.

Each seaming roller on a canning machine must be closely positionable against the flange of the can lid within a very small tolerance to assure formation of an acceptable seam. The die surfaces of the seaming roller body should be freely rotatable and held against the can lid flange without deviating in any direction by more than about 0.001 inch (0.025 mm). To maintain the roller body in proper adjustment, the positioning and alignment of the bearings and the roller body with respect to the spindle are critical. The roller body and the bearings must be adjustably positionable with respect to the spindle so that the roller body is freely rotatable about the spindle. At the same time, float between the bearings must be substantially eliminated so that the roller body rotates with little or no deviation from the axis of the spindle.

In a typical canning machine, the seaming rollers must be replaced relatively frequently. Each different size and type of can generally requires a different size seaming roller. In addition, even under otherwise optimal conditions, the seaming rollers and die surfaces wear and must be replaced after being used to seal approximately one million cans. The alignment, positioning, and rotation of the roller body of each seaming roller must be checked and adjusted each time the seaming rollers are replaced. In known seaming rollers, this is a very time-consuming and, therefore, costly process.

For maximum life of the individual seaming rollers, the roller bodies and the bearings must be properly positioned to substantially eliminate any float between the bearings and thus any wobble of the roller body on the spindles. In addition, to maximize the useful life of the bearings, the bearings must be greased; the grease used is edible and non-toxic to avoid dangerous contamination of the contents of the cans. Since the roller bodies are in continual motion during operation, it is highly desirable to apply the grease to the roller body bearings through the generally stationary spindle.

Several devices and arrangements intended to accurately position the roller body and the bearings with respect to the spindle are known. Each of these will be described and discussed below in conjunction with the detailed description of the preferred embodiment of the present invention. For various reasons, each of these prior devices or arrangements has proved unsuccessful or inconvenient and undesirable for use.

SUMMARY OF THE INVENTION

An improved seaming roller for use in automated canning machines to form seams between can lids and can bodies is disclosed. The seaming roller comprises a spindle mountable to the canning machine, a roller body rotatable about the spindle and having die surfaces for pressing against can lids to form seals, a pair of roller bearings to facilitate rotation, and a grease path for lubricating the bearings through the spindle. The seaming roller includes a positioner screw for properly positioning the roller body and bearings on the spindle such that the roller body can rotate freely without wobble and thus maintain the die surfaces in proper engagement to the can lids.

A throughgoing bore is defined along the length of the spindle. The positioner screw is locked in position with a locking pin, inserted in the throughgoing bore and a locking screw which forces the locking pin against the positioner screw.

In the preferred embodiment, the grease path includes a grease port in the spindle communicating with the throughgoing bore, an annular indentation about the locking pin at a position corresponding to that of the grease port, a grease duct along the interior of the locking pin, and a grease bore along the length of the positioner screw. The annular indentation is fluidly coupled to the grease duct, and the grease bore is fluidly coupled to the bearings.

Seaming rollers according to the present invention can be set up and properly positioned for engaging the can lids to a high tolerance with a time saving of 90–95% over the analogous operations with known seaming rollers. Seaming rollers according to the present invention also maintain their proper positions better than known seaming rollers and have a longer useful life.

DETAILED DESCRIPTION OF THE PREFERRED EMBODIMENT

Figure 1:
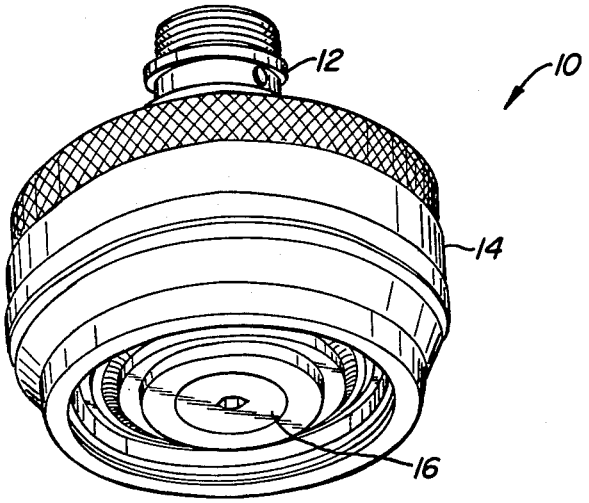
FIG. 1 is a perspective view of a typical seaming roller.

The preferred seaming roller 10 according to the invention is shown in perspective view in FIG. 1. The exterior appearances of known seaming rollers are closely analogous to preferred seaming roller 10; thus, FIG. 1 is generally equally applicable to the discussion below of prior art seaming rollers and the preferred seaming roller 10 of the invention.

Seaming roller 10 includes generally a spindle 12 and a roller body 14 which is held to spindle 12 with a positioning screw 16. Seaming roller 10 shown in FIG. 1 is representative of equipment manufactured commercially by Angelus Sanitary Can Machine Co., Los Angeles, Calif. The preferred embodiment of the invention will be described with particular reference to seaming rollers designed to be replacement parts for the Angelus seaming rollers. Howwever, it will be understood that the invention is not so limited and is equally applicable to seaming rollers for replacing original equipment from other manufacturers.

Figure 2:
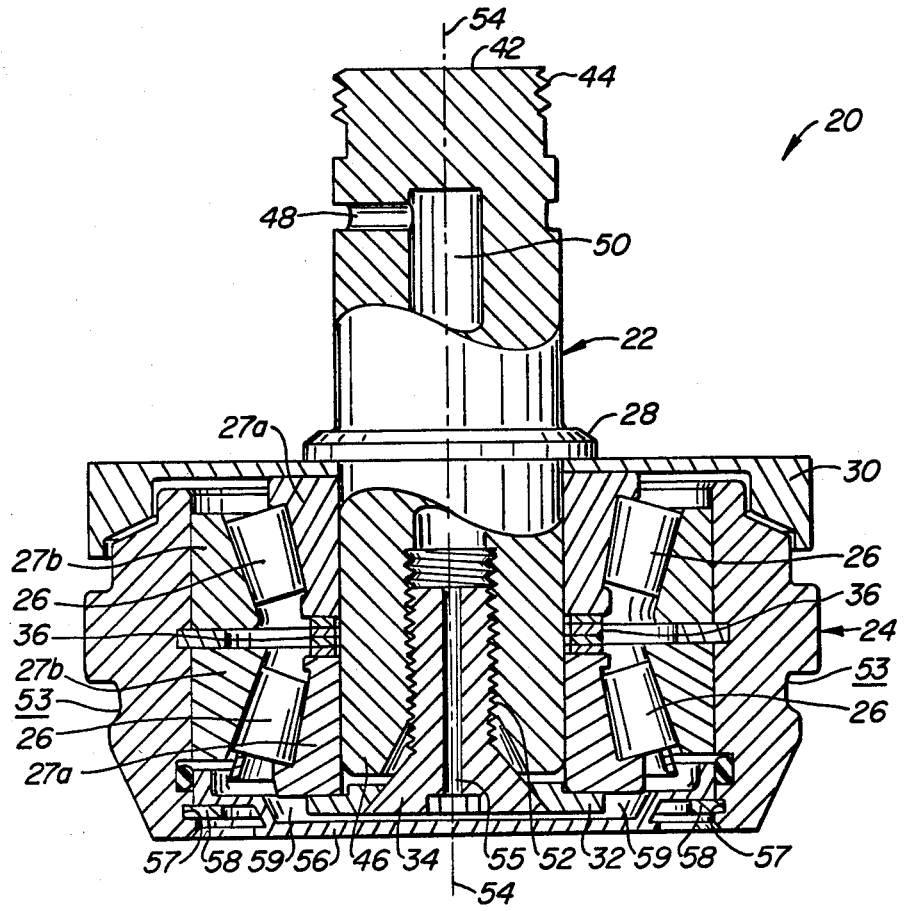
FIG. 2. PRIOR ART
FIG. 2 is a cross-sectional view of a prior art seaming roller.

A prior art seaming roller 20 is shown in cross-sectional elevation view in FIG. 2. Prior art seaming roller 20 includes a spindle 22, a roller body 24, a pair of tapered roller bearings 26 with inner and outer bearing cups 27*a* and 27*b*, a flange 28, an upper shield 30, a roller retainer 32, a retaining screw 34, and a shim 36.

Spindle 22 is generally cylindrical and has an upper end 42, threads 44 in the region of upper end 42 for attaching seaming roller 20 to the canning machine (not shown), a bottom end 46, a grease port 48, and a grease path 50 fluidly coupled to grease port 48 and extending from grease port 48 to lower end 46. Prior art seaming roller 20 also includes, defined along the interior of grease path 50 in the region of second end 46, retaining threads 52 for engaging retaining screw 34.

Roller body 24 includes, along its periphery, a die surface 52 for engaging a can lid to perform the two sealing operations discussed above.

Retaining screw 34 generally holds roller body 24, bearings 26, and upper shield 30 against flange 28. Shims 36 are provided between bearings 26 to eliminate float. During use, roller body 24, shim 36, and outer bearing cups 27*b* rotate while spindle 22, upper shield 30, and inner bearing cups 27*a* remain generally stationary relative to such rotation. Bearings 26 and roller body 24 must be precisely positioned to eliminate float and simultaneously allow free rotation. If retaining screw 34 is over-tightened, roller body 24 will bind against upper shield 30 and flange 28, thus restricting the rotation of roller body 24 about spindle 22. On the other hand, if retaining screw 34 is too loose, bearings 26 will float, allowing roller body 24 to wobble as it rotates about spindle 22. The amount of wobble can be conveniently defined by the extent to which a spindle axis, defined through the center of spindle 22, is allowed to deviate from a body axis (not separately shown), defined as the cylindrical axis of roller body 24. As discussed above, to assure that die surfaces 53 maintain the proper contact with the can flange, it is necessary to prevent deviations of the position of die surfaces 53 as roller body 24 rotates about spindle 22. Typically, this deviation should be maintained to less than about 0.001 inch (0.0025 mm). To this end, shim 36 is used to properly space apart bearings 26. Retaining screw 34 is then adjusted to tighten roller body 24, bearings 26, and shim 36 against upper shield 30 and therefore against flange 28. If shim 36 has been chosen to be of the proper thickness, when retaining screw 34 has been fully tightened, roller body 24 will freely rotate about spindle 22 with an amount of wobble that is within the desired tolerance.

Prior art seaming roller 20 also includes a grease bore 55 defined approximately along the center of retaining screw 34, a grease cap 56, and a retaining ring 58. Retaining ring 58 fits into an annular slot 57 defined in roller body 24, and serves to retain grease cap 56 over retaining screw 34 and retainer 32. Grease is applied to bearings 26 via grease port 48, grease path 50, grease bore 55, and a grease reservoir 59 defined between grease cap 56 and roller bearing 26.

Prior art seaming roller 20 suffers from significant disadvantages. Since bearings 26 and roller body 24 will vary in dimension somewhat from one prior art seaming roller 20 to another, the appropriate thickness of shim 36 must be determined for each prior art seaming roller 20 by a trial-and-error process. That is, prior art seaming roller 20 is disassembled, shims 36 are inserted between bearings 26, and prior art seaming roller 20 is reassembled. After tightening retaining screw 34, prior art seaming roller 20 is tested for freedom of rotation and wobble of roller body 24 as roller body 24 is manually rotated about spindle 22. If rotation is overly restricted, prior art seaming roller 20 is disassembled and shims 36 of slightly smaller width are inserted. If, on the other hand, the wobble is too great, prior art seaming roller 20 is disassembled and thicker shims 36 are used. Sometimes a stack of many (up to 20 or 30) shims 36 are required. This process is continued until shims 36 of the appropriate thickness have been found.

Determining shims 36 of appropriate thickness generally requires a minimum of about one-half hour for each prior art seaming roller 20. Since the typical automated canning machine (not shown) utilizes twelve or more such prior art seaming rollers 20, even an experienced operator may take six to eight hours in changing prior art seaming rollers 20. Since the seaming rollers 20 must be replaced after about one million cans have been sealed, and for each different type and size of can, these operations cause significant and expensive interruptions in the use of the canning machine.

Further, during operation, due to the contact between, for example, bearing 26 and retainer 32 with retaining screw 34, retaining screw 34 tends to "back out" or lose its adjustment. This latter problem is particularly pronounced during prolonged periods of operation, when prior art seaming roller 20 tends to get hot. When any single retaining screw 34 in the canning machine loses its appropriate adjustment, the entire machine must be halted for readjustment of the misadjusted retaining screw 34. This can also contribute to significant and costly delays in the operation of the canning machine.

Figure 3:
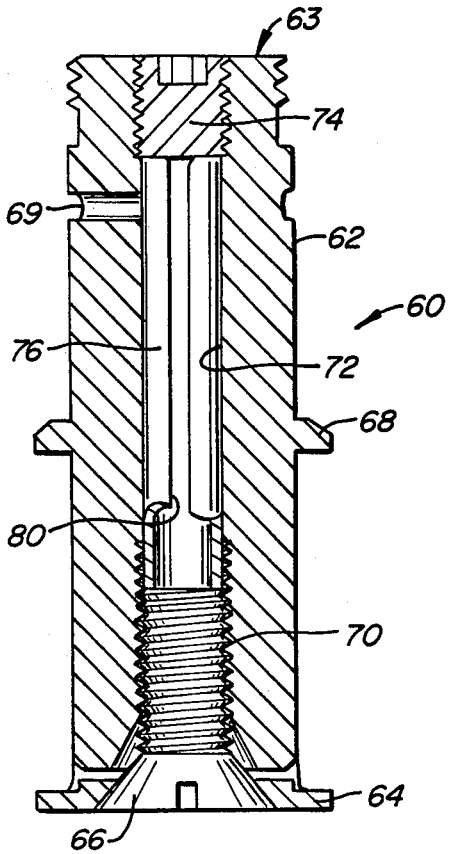
FIG. 3 is a cross-sectional view of a prior spindle and locking device.

One arrangement intended to alleviate these disadvantages of prior art seaming roller 20 is shown in FIG. 3 and designated generally as prior locking spindle 60. Only prior locking spindle 60 is shown in FIG. 3; the corresponding roller body, bearings, etc., are not shown in FIG. 3 for clarity, but are analogous to roller body 24, bearings 26, etc., as shown in FIG. 2. Spindle 60 includes a roller spindle 62 configured generally to substitute for spindle 22 of FIG. 2, an upper end 63, a retainer 64, a retaining screw 66, a flange 68, and a grease port 69. Retaining screw 66 is adjustable to position the roller body (not shown) and bearings (not shown) between flange 68 and retainer 64 with a threaded section 70 so that the roller body is freely rotatable about roller spindle 62 with substantially no wobble.

Unlike prior art seaming roller 20, as shown in FIG. 2, prior locking spindle 60 (FIG. 3) includes, in addition, a throughgoing bore 72, a set screw 74, and a locking roll pin 76. Throughgoing bore 72 is generally aligned with threaded section 70 along the axis of roller spindle 62 and is tapped in the region of upper end 63 to receive set screw 74.

Locking roll pin 76 is a hollow, generally cylindrical member, and has a slot 80 along the entire length of locking roll pin 76. Locking roll pin 76 is generally sized to be inserted within throughgoing bore 72 between retaining screw 66 and set screw 74. Set screw 74 is adjusted to force locking roll pin 76 against retaining screw 66 and cause retaining screw 66 to bind against threaded section 70, to lock the adjustment of retaining screw 66 with respect to flange 68. Slot 80 is intended to provide locking roll pin 76 with some resiliency so that locking roll pin 76 will act as a spring between set screw 74 and retaining screw 66. At the same time, slot 80 is intended to fluidly communicate with grease port 69 and allow the introduction of grease into the hollow center of locking roll pin 76 and thence to retaining screw 66.

Prior spindle 60 has proved to be unsuccessful. First, locking roll pin 76, due to the presence of slot 80 along its entire length, is too flimsy to securely lock retaining screw 66 against threaded section 70. Thus, retaining screw 66 is not positively locked in place and tends to back out during operation of the canning machine when the roller body rotates. Further, the introduction of grease into the center of locking roll pin 76 is, at best, intermittent due to the low probability that slot 80 is aligned with grease port 69.

Figure 4:
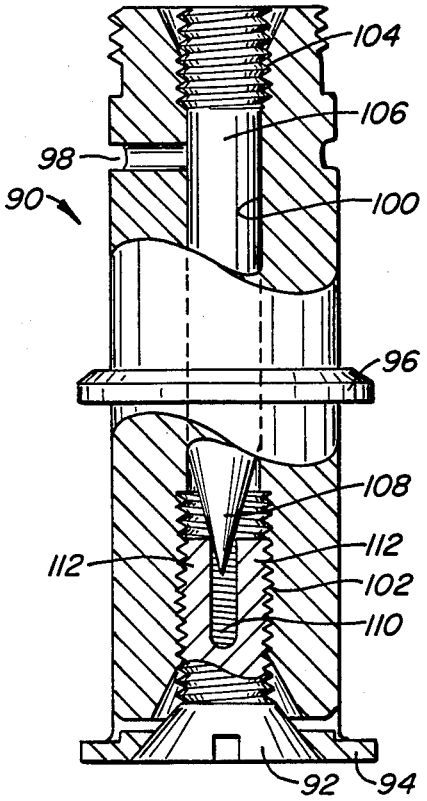
FIG. 4 is a cross-sectional view of an experimental spindle and locking device.

An experimental roller spindle 90, intended to alleviate these problems and those of prior art roller spindle 20, is shown in FIG. 4. Experimental spindle 90 includes, as does spindle 22 of prior art seaming roller 20 (FIG. 2), a retaining screw 92, a retainer 94, a flange 96, and a grease port 98. Like prior locking spindle 60 (FIG. 3), experimental spindle 90 includes a throughgoing bore 100 and, defined along the interior of throughgoing bore 100, a threaded section 102 for adjustment of retaining screw 92, and locking threads 104 at the opposite end of throughgoing bore 100.

Experimental spindle 90 also includes a tapered locking pin 106 threaded at one end to engage locking threads 104, and having at its other end a conical tapered section 108. Between locking threads 104 and tapered section 108, tapered locking pin 106 has a diameter significantly smaller than the diameter of throughgoing bore 100 so that grease introduced through grease port 98 can pass between experimental locking pin 106 and a wall of throughgoing bore 100 toward retaining screw 92.

In experimental spindle 90, retaining screw 92 has a slot 110. Slot 110 extends across the entire diameter of retaining screw 92 and thus splits retaining screw 92 into two legs 112. After retaining screw 92 is adjusted to correctly position the roller body and bearings, tapered locking pin 106 is forced into slot 110 to force legs 112 against the sides of throughgoing bore 100 and thus lock retaining screw 92 in position. While experimental spindle 90 allows better application of grease to the bearings than does prior locking spindle 60, experimental spindle 90 is generally unsuccessful in locking retaining screw 92 in position. While experimental spindle 90 is easily adjustable, the ends of legs 112 tended to cut into tapered section 108; this damages taper locking pin 106 and causes it to fail in its intended locking function. Under actual operating conditions, experimental spindle 90 does not hold its adjustment due to heat build-up and rotation of retaining screw 92.

Figure 5:
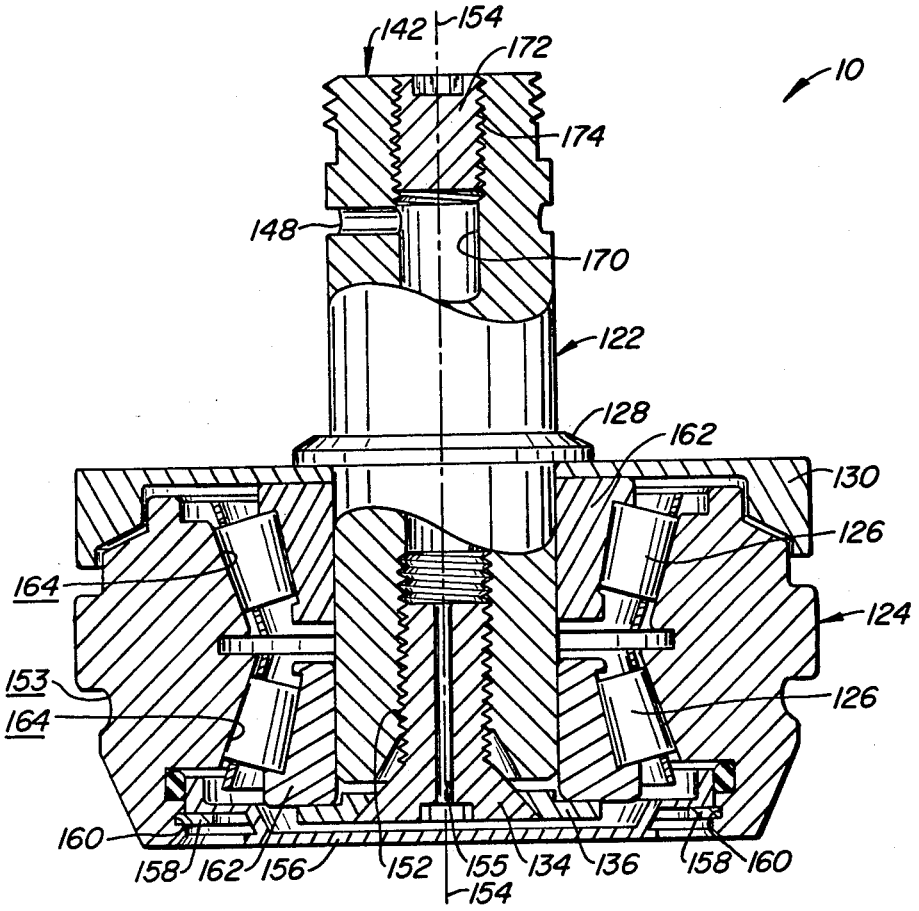
FIG. 5 is a cross-sectional view of the preferred seaming roller according to the invention, taken along a section analogous to that of FIG. 2.

The preferred seaming roller 10 of the invention is shown in cross-sectional elevation view in FIG. 5. Since seaming roller 10 is intended to replace, for example, prior art seaming roller 20, seaming roller 10 is configured generally similarly to prior art seaming roller 20. Seaming roller 10 includes several elements that are generally analogous to the elements of prior art seaming roller 20 (FIG. 2); these parts of seaming roller 10 are given numbers in FIG. 5 which are increased by one hundred over the analogous elements indicated in FIG. 2. Seaming roller 10, as shown in FIG. 5, uses bearings 126 having only inner cups 162; in this embodiment of the invention, roller body 124 is formed to have frustoconical bearing surfaces 164 on which bearings 126 seat. In alternate embodiments of the invention, bearings 126 could have both inner and outer cups analogous to bearing 26 of FIG. 2. Due to the difficulty of accurately machining bearing surfaces 164, it may be desirable to use such doubly-cupped bearings. However, the arrangement shown in FIG. 5 is preferred since bearings 126 are thus made self-centering with respect to roller body 124.

Preferred spindle 122 includes a throughgoing bore 170, a locking screw 172, and locking threads 174.

Figure 6:
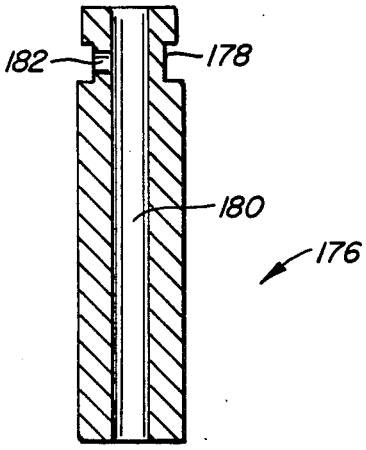
FIG. 6 is a detail cross-sectional view of the locking pin of the preferred embodiment of the invention.

Preferred seaming roller 10 also includes a locking pin 176 which is insertable in throughgoing bore 170 between positioner screw 134 and locking screw 172. Locking pin 176 is shown in cross-section in FIG. 6.

Locking pin 176 is generally cylindrical and sized to fit fairly closely but slidably in throughgoing bore 170. Locking pin 176 is preferably made of stainless steel or another hard and durable metal. Upper end 142 of bore 170 has locking threads 174 sized to permit passage of pin 176 therethrough.

Locking pin 176 includes, at a position which corresponds to the location of grease port 148, an annular indentation 178 about its entire circumference. Between annular indentation 178 and retaining screw 134, locking pin 176 has an axial grease duct 180. Conveniently, grease duct 180 extends along the entire length of locking pin 176. Annular indentation 178 and grease duct 180 are fluidly coupled with a grease connection hole 182 in pin 176. Hole 182 has a diameter approximately equal to that of grease duct 180. Grease duct 180 is aligned with grease bore 154 of positioner screw 134.

Preferred seaming roller 10 can be conveniently and simply assembled to position roller body 124 and bearings 126 for proper rotation of roller body 124 about spindle 122. Positioner screw 134 is adjusted to properly position retainer 136, bearings 126, roller body 124, and upper shield 130 against flange 128. For proper adjustment, positioner screw 134 is simply screwed into throughgoing bore 170 until wobble of roller body 124 is substantially eliminated (that is, the cylinder axis of spindle 122 is substantially coincident with the body axis of roller body 124) while still permitting free rotation of roller body 124 about spindle 122. The float between bearings 126 is eliminated by the self-centering arrangement of bearings 126 on bearing surfaces 164 by simply tightening positioner screw 134 the proper amount. Locking pin 176 is then inserted in throughgoing bore 170 and locked against positioner screw 134 with locking screw 172 so that the threads of positioner screw 134 are forced against and bind to positioner screw threads 152.

It has been found that this arrangement, using preferred locking pin 176, securely positions and locks positioner screw 134 under all conditions of operation and heat buildup likely to be encountered in an automated canning machine. By the elimination of the need to use shims 36 of various sizes, as is required with prior art seaming roller 20 (FIG. 2), the use of preferred seaming roller 10 as a replacement for prior art seaming roller 20 greatly reduces the time required to replace and properly position die surfaces 153. A machine operator can typically properly adjust and replace preferred seaming roller 120 in one to two minutes. The trial-and-error process of determining the correct thickness of shims 36 is eliminated; set-up time for a canning machine having twelve seaming rollers 10, is reduced by a factor of ten to twenty over that required for a machine using a like number of prior art seaming rollers 20.

In addition, the difficulties encountered with prior roller spindle 60 in properly greasing bearings 126 are eliminated through the use of preferred locking pin 176. With annular indentation 178, the alignment between grease port 148 and grease connection 182 is not critical; for any such orientation, grease introduced through grease port 148 flows to grease connection 182 and grease duct 180 around and through annular indentation 178.

Further, the inability of the arrangement of experimental spindle 90 to satisfactorily lock retaining screw 92 during the operation of the canning machine has been eliminated by the flat mating between preferred locking pin 176 and retaining screw 134.

While the above is a complete description of the preferred embodiment of the invention, other arrangements and equivalents are possible and may be employed without departing from the true spirit and scope of the invention. For example, the invention and preferred seaming roller 10 have been described in relation to a replacement for prior art seaming roller 20, which is manufactured and specifically adapted to canning machines manufactured by Angelus Sanitary Can Machine Co. However, as will be apparent to those skilled in the art, the invention is equally applicable to canning machines and seaming rollers from other original equipment manufacturers. Therefore, the above description and illustrations should not be construed as limiting the scope of the invention, which is delineated by the appended claims.

What is claimed is:

1. A seaming roller for use in a canning machine to join a lid to a can body comprising:

a spindle having a spindle axis, a throughgoing bore defined along the spindle axis, first and second ends, and an annular flange between the first and second ends, the first end including means for mounting the spindle to the canning machine;

a roller body for engaging the lid;

first and second bearings for mounting the roller body to rotate around the spindle;

positioner means, adjustably fixable in the throughgoing bore in the region of the second end, for positioning the bearings and the roller body against the annular flange; and locking means, removably mountable in the throughgoing bore and adjustably fixable to the roller spindle adjacent the first end, for tightly engaging the positioner means within the throughgoing bore, thereby fixing the adjustment of the positioner means.

2. The seaming roller of claim 1 wherein:

each bearing is a singly-cupped, tapered roller bearing disposed about the spindle; and the roller body defines a pair of generally frustoconical bearing surfaces for spacing the bearings apart, each bearing surface being tapered to support one of the bearings.

3. The seaming roller of claim 1 further comprising:

a grease cap engageable to the roller body over the second end and the positioner means to form a grease reservoir for providing grease to the bearings; and a retaining ring engageable to the roller body to retain the grease cap thereto; wherein:

the spindle includes a grease port for communicating grease to the locking means;

the locking means includes a grease path for communicating grease from the grease port to the positioner means; and the positioner means includes a grease bore for communicating grease from the grease path to the grease reservoir.

4. The seaming roller of claim 3 wherein:

the grease port is a hole defined in the spindle between the first end and the annular flange; and the grease path includes a grease duct extending along the spindle from the grease port to the positioner means an annular indentation encircling the locking means and positioned to be alignable with the grease port and a grease connection for fluidly coupling the annular indentation and the grease bore.

5. The seaming roller of claim 1 wherein the roller body is rotatable, to within about 0.001 inch over the length of the spindle, concentrically with the spindle.

6. The seaming roller of claim 1 wherein a spindle includes positioner screw threads interior of the throughgoing bore adjacent the second end and locking screw threads defined interior of the throughgoing bore adjacent the first end and projecting away from the throughgoing bore;

the positioner means comprises a positioner screw threaded to engage the positioner screw threads; and the locking means includes a threaded locking section and a rigid pin section, the pin section being sized to fit in the throughgoing bore, the locking section being engageable to the locking screw threads to force the pin section against the positioner screw and the positioner screw against the positioner screw threads so as to fix the position of the positioner screw in the throughgoing bore.

7. The seaming roller of claim 6 wherein the pin section comprises a cylinder having, toward the second end of the spindle, a substantially flat pin end transverse the thoroughgoing bore for engagement to a correspondingly shaped surface of the positioner screw.

8. The seaming roller of claim 6 wherein the threaded locking screw section and the pin section are formed to be separate pieces.

9. The seaming roller of claim 6 further comprising:

a grease cap engageable to the roller body over the second end and the positioner means to form a grease reservoir for providing grease to the bearings; and a retaining ring engageable to the roller body to retain the grease cap thereto; wherein:

the spindle includes a grease port for communicating grease to the locking means;

the locking means includes a grease path including an annular indentation encircling the locking means and positioned to be alignable with the grease port, and a grease duct extending along the spindle axis from the grease port to the positioner means and opening into the annular indentation; and the positioner means includes a grease bore for communicating grease from the grease path to the reservoir.

10. A method for assembling a seaming roller according to claim 6 so as to enable the roller body to rotate concentrically with the spindle to within about 0.001 inch over the length of the spindle, the method comprising the steps of:

inserting, in order, one of the roller bearings, the roller body, and the other of the roller bearings on the spindle from the second end against the flange;

screwing the positioner screw into the throughgoing bore onto the positioner screw threads until the roller body rotates freely about the spindle with substantially no wobble;

inserting the pin into the throughgoing bore from the first end; and screwing the locking screw onto the locking screw threads until the pin locks against the positioner screw.

11. A seaming roller for a canning machine comprising:

a generally cylindrical spindle having a first end including means for mounting the roller spindle to the canning machine, a second end, a throughgoing bore aligned along a spindle axis, positioner screw threads along the interior of the throughgoing bore in the region of the second end, locking screw threads defined along the interior of the throughgoing bore in the region of the first end and projecting away from the throughgoing bore, and a grease port between the locking screw threads and the second end for introducing grease into the throughgoing bore;

a flange fixed around the roller spindle between the grease port and the second end;

a roller body freely rotatable about the spindle and including a pair of generally frusto-conical bearing surfaces;

a pair of tapered roller bearings disposed about the spindle, each roller bearing being supported on a corresponding one of the bearing surface;

a positioner screw threaded to engage the positioner screw threads for positioning the roller bearings and the roller body against the flange such that the roller body is rotatable, to within about 0.001 inch over the length of the spindle, concentrically with the spindle, the positioner screw having a grease bore defined substantially along the spindle axis;

a rigid locking pin slidable into the throughgoing bore, having a diameter less than the diameter of the throughgoing bore, and generally extending between the positioner screw and the locking screw threads, the locking pin including a grease duct defined therethrough substantially along the spindle axis and an annular indentation defined around the periphery of the locking pin in the region of the grease port and fluidly coupled to the grease duct; and a locking screw threaded to engage the locking screw threads and adjustable thereon to engage the locking pin, force the locking pin against the positioner screw and thereby bind the positioner screw against the positioner screw threads, and lock the adjustment of the positioner screw.

* * * * *